United States Patent [19]

Beattie

[11] Patent Number: 4,932,171

[45] Date of Patent: Jun. 12, 1990

[54] PERIMETER SECUREMENT FOR MEMBRANE ROOF AND METHOD OF ATTACHING

[75] Inventor: Doug J. Beattie, Stroud, Canada

[73] Assignee: Carlisle Corporation, Cincinnati, Ohio

[21] Appl. No.: 323,613

[22] Filed: Mar. 13, 1989

[51] Int. Cl.[5] ..... E04D 5/00

[52] U.S. Cl. ..... 52/58; 52/273; 52/408; 52/746

[58] Field of Search ..... 52/58, 60, 408, 410, 52/200, 741, 746, 273

[56] References Cited

U.S. PATENT DOCUMENTS

| | | | |
|---|---|---|---|
| 720,811 | 2/1903 | Ingram | 52/58 |
| 1,044,773 | 11/1912 | Gillett | 52/58 |
| 1,710,484 | 4/1929 | Luther | 52/58 |
| 1,731,328 | 10/1929 | Witter | 52/58 |
| 4,706,418 | 11/1987 | Stewart | 52/58 |
| 4,712,348 | 12/1987 | Triplett et al. . | |

FOREIGN PATENT DOCUMENTS

| | | | |
|---|---|---|---|
| 871960 | 6/1971 | Canada . | |
| 957477 | 11/1974 | Canada . | |
| 1174024 | 11/1974 | Canada . | |
| 961233 | 1/1975 | Canada . | |
| 2556713 | 6/1977 | Fed. Rep. of Germany | 52/58 |

OTHER PUBLICATIONS

Drawing No. U-5-A, dated 6/1/88, Carlisle SynTec Systems, Wood Curb Vertical Roofs.

Drawing No. U-5-B, dated 6/1/88, Carlisle SynTec Systems, Wood Curb Horizontal Roofs.

Drawing No. U-4-A, dated 6/1/88, Carlisle SynTec Systems, Parapet/Curb Flashing Uncured Membrane.

Drawing No. U-4-B, dated Jun. 1, 1988, Carlisle SynTec Systems, Parapet/Curb Flashing Uncured Membrane.

*Primary Examiner*—John E. Murtagh

*Attorney, Agent, or Firm*—Wood, Herron & Evans

[57] ABSTRACT

A method of attaching the perimeter of a membrane roof to a roof deck and an abutting parapet wall is disclosed. The method employs a flexible attachment strip which is mechanically fastened to either the parapet wall or the roof deck. The membrane covers the attachment strip and is secured to the horizontal portion of the attachment strip and adhered to the parapet wall. The attachment strip is a flexible strip of either fabric reinforced or non-reinforced membrane. The attachment member can be either attached to the parapet wall or can be attached to the roof deck at the foot of the parapet wall. This improves the wind uplift resistance of the perimeter securement and reduces installation cost.

7 Claims, 1 Drawing Sheet

PERIMETER SECUREMENT FOR MEMBRANE ROOF AND METHOD OF ATTACHING

BACKGROUND OF THE INVENTION

Membrane roof systems typically refer to roof decks covered with a water impermeable sheet of polymeric material such as ethylene propylene diene rubber (EPDM), chlorinated polyethylene, polyvinyl chloride, or chlosuffanated polyethylene. These roof systems are formed by covering a roof deck with a single ply of roofing membrane The roof membrane is typically held to the roof in one of several ways. For example, the entire roof membrane can be secured using adhesives. Alternately, the membrane can be secured solely with ballast Another approach is to secure the membrane using penetrating or nonpenetrating mechanical fasteners.

As disclosed in U.S. Pat. No. 4,649,686 entitled "High Wind Resistant Membrane Roof System" the wind uplift forces are not evenly distributed throughout the roof. The perimeter of a roof particularly next to a parapet wall encounters higher wind uplift forces than are encountered in the field of the roof. A parapet wall is a wall extending directly above the roof deck generally at its perimeter One typical way of securing a membrane to a roof at a parapet wall is to use a batten bar fastening the membrane to the roof deck at the foot of the parapet wall. Flashing is adhered to the membrane covering the batten bar and also to the parapet wall This has been found to be particularly effective. Unfortunately this method is labor intensive and consequently quite expensive.

Another method typically used is to run a continuous sheet of field membrane as wall flashing. In other words, run the field membrane up the wall and adhere it to the side of the wall. This unfortunately is unsatisfactory because of the high uplift forces that are encountered at the perimeter of a roof. This could cause the membrane to separate from the parapet wall.

SUMMARY OF THE INVENTION

Accordingly, it is an object of the present invention to provide a method of securing the perimeter of a membrane roof as it abuts against the parapet wall in a manner which reduces labor and material costs but which does not decrease field performance.

Further it is an object of the present invention to secure the perimeter of a membrane using a mechanically fastened attachment strip which is attached to either the parapet wall or to the roof deck at the foot of the parapet wall. The perimeter of the membrane is then adhered to this attachment strip and to the parapet wall. The securement strip is a reinforced single ply piece of polymeric membrane which is mechanically fastened to the roof deck or parapet wall.

Other objects and advantages of the present invention will be further appreciated in light of the following detailed description and drawings.

DETAILED DESCRIPTION OF THE INVENTION

Figure 1:
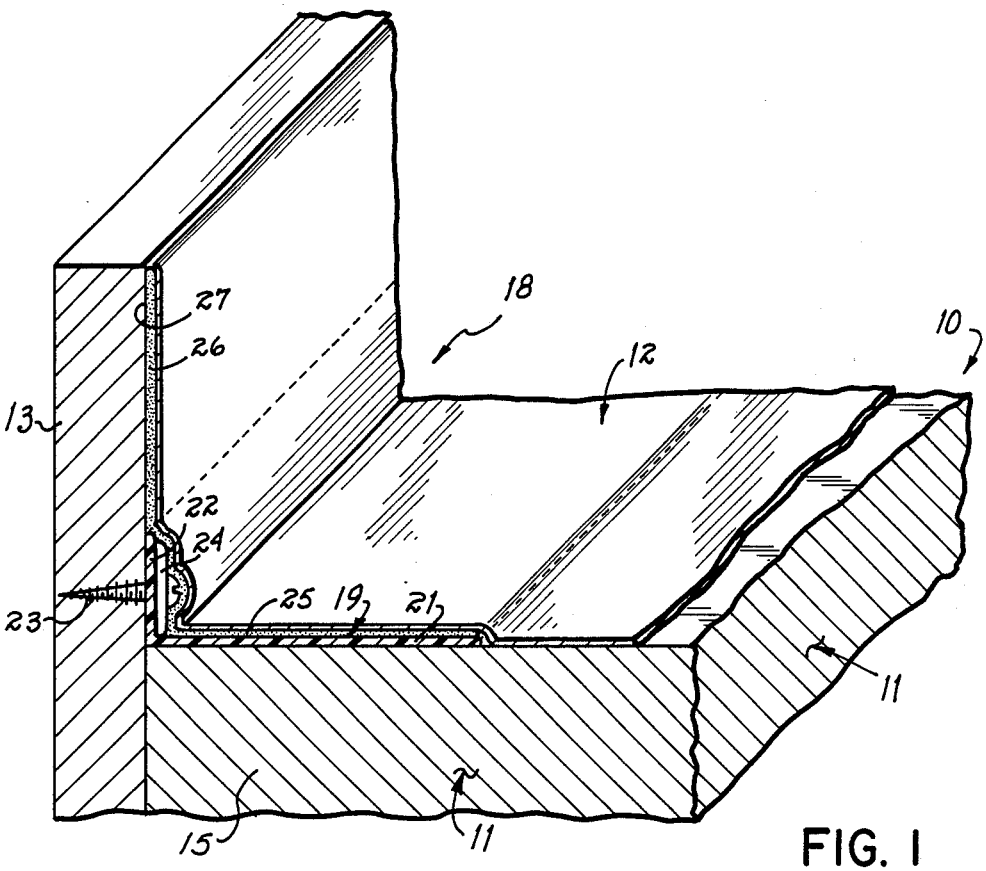
FIG. 1 is a perspective view of the present invention broken away and partially in cross-section.

As shown in FIG. 1, there is a roof system 10 which includes a supporting roof deck 11 which is covered by a single ply membrane 12. At the perimeter 15 of the roof deck 11 is a parapet wall 13 which extends upwardly from the roof deck 11 above the plane of the roof deck. The membrane 12 is attached using various systems throughout the roof deck.

Different methods of attaching the field of a roof to a roof deck are disclosed in for example U.S. Pat. No. 4,649,686. The field portion of the membrane can for example be attached using ballast, i.e., gravel. It can be attached using penetrating fasteners such as batten bars and non-penetrating fasteners such as those disclosed in Resan U.S. Pat. No. 4,519,175. There are a variety of different nonpenetrating fasteners and other fastening systems developed to attach the field portion of the roof membrane to the deck The particular method of attaching the membrane to the roof deck generally forms no part of the present invention.

The perimeter portion 18 of the membrane 12 is attached to the roof deck 11 using an attachment strip 19. Attachment strip 19 as shown in FIG. 1 is a flexible membrane strip. Preferably strip 19 is a fabric reinforced membrane such as EPDM, however, strip 19 could be non-reinforced.

The attachment strip 19 includes a horizontal portion 21 which lies parallel with the plane of the roof deck 15 as well as a vertical member 22 which lies parallel to the plane of the parapet wall 13. This strip 19 extends along the entire parapet wall and is mechanically fastened to the parapet wall 13 by a plurality of various anchoring devices as shown screws 23 which extend through three inch wide fastening plates 24 and into the parapet wall 13. Anchoring bars or strips can also be used These are applied at various intervals depending upon anchoring device pullout requirements.

The edge portion 18 of membrane 12 is adhered to the horizontal portion 21 of the attachment strip 19 using an adhesive Any adhesive, tape, solvent or hot air weld capable of holding the membrane to the attachment strip when uplift forces of one pound per square or greater are encountered is suitable. Neoprene adhesives are generally suitable for bonding EPDM sheeting to a roof deck for example Uniroyal M6317. Block polymer based adhesives such as Kraton based adhesives are also suitable. Butyl adhesives such as Uniroyal M6365 are also suitable. Alternately, a splicing tape can be employed such as butyl based splicing tapes such as those disclosed in Chiu U.S. Pat. No. 4,533,637.

A layer of adhesive 26 is also applied to the surface 27 of parapet wall 13 bonding the membrane 12 to the parapet wall so that the top of the membrane is at a level well above the high water line and preferably at least about 6" above the roof deck 15.

This provides a roof system having a perimeter secured to a parapet wall which withstands high wind uplift forces, is less costly than systems which require batten bars and additional flashing.

This system is applied simply by laying the membrane over the roof and attaching the membrane 12 to the field portion of the roof in the desired manner (not shown). If ballast is used this is applied last. The perimeter edge 18 of membrane 12 lying against the parapet wall is then pulled back. The attachment strip 19 is attached to the parapet wall using a plurality of various anchoring devices The adhesive layer 25 either as an adhesive or a splicing tape is applied over the horizontal portion 21 of the attachment strip 19.

Additional adhesive 26 is then applied against both the surface 27 of parapet wall 13 and the extreme edge 18 of membrane 12. Where splicing tape is used, the membrane area which will contact the tape does not have adhesive applied. Edge 18 is pressed against and adhered to the vertical surface 22 of the attachment strip and surface 27 of parapet wall 13. As an alternate, the extreme edge 18 of membrane 12 may be solvent or hot air welded to the attachment strip 19. When wind uplift forces are encountered the roofing membrane 12 flexes upwardly pulling strip 19 with it. This maintains the forces between strip 25 and membrane 12 in shear (which provides a stronger bond) as opposed to peel.

Figure 2:
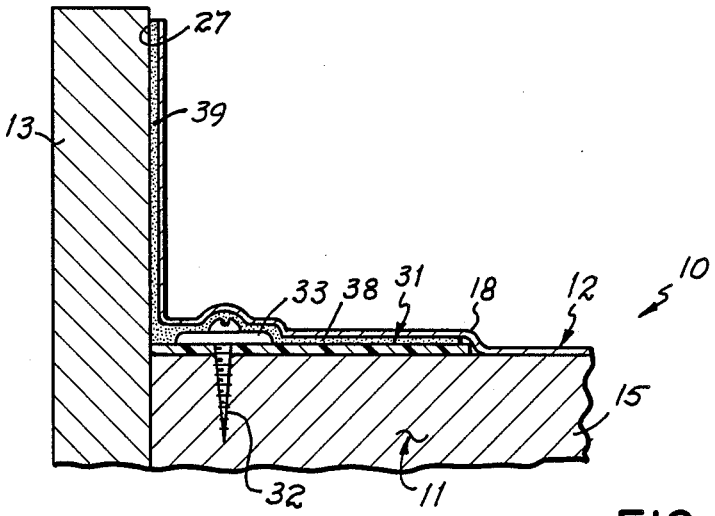
FIG. 2 is a cross-sectional view of a first alternate embodiment of the present invention.

FIG. 2 shows an alternate embodiment of the present invention. In FIG. 2 all details of the perimeter securement system and method of attachment are the same as described with reference to FIG. 1 with the exception that the attachment strip 31 (referred to as attachment strip 19 in FIG. 1) is fastened to the roof deck.

As with the embodiment shown in FIG. 1 the anchoring devices 32 and 33 attach strip 31 to the deck with the membrane 12 attached at its edge portion 18 by an adhesive, tape or solvent or hot air weld 38. Additional adhesive 39 adheres the extreme edge of membrane 12 to the surface 27 of parapet wall 13. In this embodiment the flexible attachment strip 31 has only a horizontal portion lying on the roof deck at the foot of parapet wall 13. Anchoring devices 32 hold strip 31 to the roof deck.

In accordance with the present invention the securement system and method of application substantially reduces the cost of perimeter securement of a roofing membrane at parapet walls and roof top penetrations relative to those systems which require a batten bar and additional flashing. Further these provide the same wind uplift resistance as batten bar systems and even greater wind uplift systems than those systems which merely adhere the membrane perimeter to the parapet wall.

The preceding has been a description of the preferred embodiment of the present invention along with the best mode currently known of practicing this invention. However, the invention should be defined only in terms of the appended claims wherein

I claim:

1. A method of attaching a roofing membrane to a parapet wall and abutting roof surface and to substantially cover an entire roof surface comprising:

fastening an attachment strip having a horizontal portion to either the base of the parapet wall or the roof surface at the foot of the parapet wall with said horizontal portion resting on said roof structure wherein said fastening strip is attached by means of a plurality of fasteners extending through said attachment strip;

adhering said membrane to said horizontal portion covering said fastening strip and said fasteners thereby providing perimeter securement of said membrane without penetrating said membrane further adhering said membrane to a portion of said parapet wall above said fastening strip thereby providing flashing around said parapet wall.

2. The method claimed in claim 1 wherein the attachment strip further has a vertical portion and said vertical portion is mechanically fastened to said parapet wall.

3. The method claimed in claim 1 wherein said attachment strip is a flexible strip.

4. The method claimed in claim 3 further comprising mechanically fastening said strip to the parapet wall immediately adjacent said roof deck leaving a horizontal portion of said strip resting on said roof deck.

5. A roof including a roof surface and an abutting parapet wall, a membrane overlying substantially said entire roof surface, an attachment strip penetrating fasteners extending through said attachment strip holding said attachment strip to said roof deck fastened to either said parapet wall or said surface of said roof deck at the foot of said parapet wall wherein said membrane having a perimeter portion wherein said perimeter portion of said membrane is adhered to a horizontal portion of said attachment strip and adhered to said parapet wall thereby acting as flashing.

6. The roof structure claimed in claim 5 wherein said attachment strip includes a horizontal portion and a vertical portion and wherein said vertical portion is mechanically fastened to said parapet wall holding said horizontal portion fixed to said roof deck.

7. The roof structure claimed in claim 5 wherein said attachment strip is a fabric reinforced flexible strip.

* * * * *